US009347223B1

(12) United States Patent
Ashton-Miller et al.

(10) Patent No.: US 9,347,223 B1
(45) Date of Patent: May 24, 2016

(54) GUTTER CLEANING DEVICE

(71) Applicant: Viper Tool Company LLC, Ann Arbor, MI (US)

(72) Inventors: James A Ashton-Miller, Ann Arbor, MI (US); Jeffrey E Terrell, Ann Arbor, MI (US)

(73) Assignee: Viper Tool Company LLC, Ann Arbor, MI (US)

( * ) Notice: Subject to any disclaimer, the term of this patent is extended or adjusted under 35 U.S.C. 154(b) by 0 days.

(21) Appl. No.: 14/697,603

(22) Filed: Apr. 27, 2015

(51) Int. Cl.
*A47L 5/14* (2006.01)
*E04D 13/076* (2006.01)
*E01H 1/08* (2006.01)

(52) U.S. Cl.
CPC ..... *E04D 13/0765* (2013.01); *A47L 5/14* (2013.01); *E01H 1/0818* (2013.01)

(58) Field of Classification Search
CPC ..... A47L 5/14; E01H 1/0818; E04D 13/0765
USPC ..... 15/363, 405
IPC ..... A47L 5/14
See application file for complete search history.

(56) References Cited

U.S. PATENT DOCUMENTS 2,623,234 A 12/1952 Brown
3,023,971 A * 3/1962 Milhous ..... E04D 13/0765 15/236.04
3,041,655 A 7/1962 Entler
4,121,320 A 10/1978 Feiner
4,319,851 A 3/1982 Arthur
4,363,335 A * 12/1982 Tapper ..... E04D 13/0765 134/167 C
4,468,835 A 9/1984 Rhodes
4,848,818 A * 7/1989 Smith ..... E04D 13/0765 15/236.04
5,056,187 A 10/1991 Higgins
5,195,209 A 3/1993 Watkins
6,185,782 B1 2/2001 Hall
6,257,256 B1 * 7/2001 Fischer ..... E04D 13/0765 134/166 C
6,471,271 B1 10/2002 Segal
6,519,809 B2 2/2003 Gutry
6,766,560 B2 7/2004 Murphy
D622,016 S 8/2010 Hofmann-Kay
7,886,399 B2 2/2011 Dayton
8,739,362 B1 6/2014 Conder
2003/0213086 A1 * 11/2003 Heavner ..... E04D 13/0765 15/236.04

* cited by examiner

*Primary Examiner* — David Redding
(74) *Attorney, Agent, or Firm* — Kelly M. McGlashen

(57) ABSTRACT

The gutter cleaning device removes wet or dry debris in the gutter after being attached to a leaf blower, and is designed to be used while standing on the ground to reach gutters at the first, second and even third story levels without the need for a ladder. The gutter cleaning device includes a nozzle arranged at an angle to the gutter so that the flow of air drives debris in a direction away from the operator, and a fluid-driven agitation device powered simply by air pressure to mechanically stir up heavy debris in the gutter or to prevent the debris from clogging the nozzle. In addition, the gutter cleaning device includes a plough that protrudes forward relative to the nozzle and mechanically lifts compacted debris from the gutter to be blown away by the same flow of air that is used to drive the agitation device.

20 Claims, 12 Drawing Sheets

Section B-B

GUTTER CLEANING DEVICE

FIELD OF THE INVENTION

The invention relates to a portable gutter cleaning device that permits a user to clean overhead gutters while standing on the ground, the gutter cleaning device using pressurized air directed through a nozzle and providing mechanisms for lifting debris into the path of the forced air.

BACKGROUND

According to the U.S. Bureau of Labor Statistics, more than 15% of occupational fatal falls are from ladders. Because ladders are also used at home, the absolute number of ladder falls is even greater. Men are three times more likely than women to experience fall injuries from ladders or scaffolds in nonoccupational settings, and the incident rate increases significantly with age irrespective of gender. In 2002, ladder-related injuries and deaths of people aged 65 and older cost the United States more than $2.6 billion. Because fall-related injuries from ladders tend to be more severe than falls at ground level, there is a need to prevent as many such falls as possible, especially among other adults.

Although fall-related injuries from ladders are not limited to older adults, consequences of injuries to older adults lend to be greater. Elderly living independently at home need to clean their gutters of leaves and other debris each fall and/or spring when living in certain regions of the country. This can be particularly challenging when gutters are filled with heavy wet debris. Living on a fixed income can make them reticent to ask for help with this chore and also reticent to purchase gutter guards because of the added expense. Furthermore, self-efficacy generated by years of living independently and doing their own chores can lead some elderly to continue climbing ladders to clean gutters, even after they have accumulated significant losses in strength, balance, physical and or cognitive capacities that place them at added risk for a fall.

A need exists for a device that will permit a user, young or elderly, to stand on the ground and reach and effectively clean gutters and downspouts at the roof edge of a building without the need for a ladder. Moreover, there is a need for such a device that will also address the challenges posed when gutters are filled with heavy wet debris.

SUMMARY

In some aspects, a gutter cleaning device includes a chassis plate having a leading end, a trailing end and a longitudinal axis that extends between the leading end and the trailing end. The chassis plate is elongated along the longitudinal axis. The gutter cleaning device includes a fluid supply tube that terminates in a nozzle, and a plough that extends outward from the leading end. The nozzle includes an outlet opening disposed adjacent the leading end, and a centerline that defines a nozzle axis and is concentric with the outlet opening. The nozzle is secured to the chassis plate such that the nozzle axis is angled acutely relative to the longitudinal axis, and nozzle-facing surface of the plough has a convex portion configured to urge debris toward the nozzle axis.

The gutter cleaning device may include one or more of the following features: The plough has a uniform thickness. The plough has a planar gutter-facing surface. The plough has a proximal end connected to the chassis plate leading end, and a distal tip that is opposed to the proximal end, and a straight line extending between the proximal end and the distal tip is angled relative to the longitudinal axis. The gutter cleaning device includes a fluid-driven agitation device disposed in the path of the fluid stream exiting the nozzle. The fluid-driven agitation device is an elongate strip of flexible material having a fixed end secured to the nozzle. The nozzle includes an axle that extends between opposed inner surfaces of the nozzle along an axis transverse to the nozzle axis. The fixed end of the elongate strip is rotatably secured to the axle via a bearing, and a free end of the elongate strip is disposed outside the nozzle. The fluid-driven agitation device is a helically shaped member. The fluid supply tube includes an outlet end connected to the nozzle, an inlet end opposed to the outlet end, the inlet end configured to be connected to a fluid supply source, a first intermediate portion that extends between the outlet end and the chassis trailing end, the first intermediate portion disposed on a first side of the chassis plate and defining a curved fluid path, and a second intermediate portion that extends between the first intermediate portion and the inlet end, the second intermediate portion disposed on a second side of the chassis plate and including telescoping elements whereby a length of the second intermediate portion is adjustable.

The gutter cleaning device may also include one or more of the following features: The chassis plate includes a first transverse axis perpendicular to the longitudinal axis that is aligned with a width direction of the chassis plate, a second transverse axis perpendicular to the first transverse axis and the longitudinal axis, the second transverse axis being aligned with the thickness direction of the chassis plate, and an adjustment line that extends between a first location on the chassis plate and the fluid supply tube. The adjustment line is connected to the fluid supply tube at a location spaced apart from the chassis plate, and the adjustment line is configured to draw the fluid supply tube toward the first location whereby the fluid supply tube is adjustable between a first position in which a centerline of the fluid supply tube is generally parallel with the second transverse axis, and a second position in which the centerline of the fluid supply tube is angled relative to the second transverse axis. The chassis plate is planar. The chassis plate is curved. A gutter-facing surface of the chassis plate is convexly curved. A gutter-facing surface of the chassis plate includes a low-friction material. The gutter cleaning device includes one or more of an optical sensor, an ultrasound sensor, a camera, a display unit, and a mirror. The gutter cleaning device includes a vee shaped tree jack.

In some aspects, a gutter cleaning device includes a chassis plate having a leading end, a trailing end and a longitudinal axis that extends between the leading end and the trailing end, the chassis plate being elongated along the longitudinal axis. The gutter cleaning device includes a fluid supply tube that terminate in a nozzle, the nozzle including an outlet opening and a centerline that defines a nozzle axis and is concentric with the outlet opening. The nozzle is secured to the chassis plate such that the nozzle axis is angled acutely relative to the longitudinal axis. The gutter cleaning device includes a plough that extends outward from the leading end, a nozzle-facing surface of the plough having a convex portion configured to urge debris toward the nozzle axis. In addition, the gutter cleaning device includes a fluid-driven agitation device disposed on the nozzle axis.

The gutter cleaning device may include one or more of the following features: The plough has a proximal end connected to the chassis plate leading end, and a distal tip that is opposed to the proximal end, and a straight line extending between the proximal end and the distal tip is angled relative to the longitudinal axis. The fluid-driven agitation device is an elongate strip of flexible material having a fixed end secured to the nozzle. The chassis includes a first transverse axis perpendicular to the longitudinal axis that is aligned with a width direction of the chassis plate, a second transverse axis perpendicular to the first transverse axis and the longitudinal axis, the second transverse axis being aligned with the thickness direction of the chassis plate, and an adjustment line that extends between a first location on the chassis plate and the fluid supply tube. The adjustment line is connected to the fluid supply tube at a location spaced apart from the chassis plate, and the adjustment line is configured to draw the fluid supply tube toward the first location whereby the fluid supply tube is adjustable between a first position in which a centerline of the fluid supply tube is generally parallel with the second transverse axis, and a second position in which the centerline of the fluid supply tube is angled relative to the second transverse axis.

The gutter cleaning device can be used while standing on the ground to reach and clean gutters and downspouts at a roof edge located at first, second and even third story levels without the need for a ladder. It removes wet or dry debris in the gutter after being attached to a source of pressurized air, such as a leaf blower. The gutter cleaning device includes the chassis plate that rests on a top edge surface of the gutter when in use. The chassis plate supports the fluid supply tube and the plough. The fluid supply tube is connected to the source of pressurized air and terminates in the nozzle that is angled toward a leading end of the chassis plate. The plough has an irregular shape configured to lift the debris into the air stream in front of the nozzle to facilitate its being blown from the gutter and away from the operator as (s)he walks parallel with the gutter. In addition, the gutter cleaning device has a fluid-driven agitation device that is anchored within the nozzle and projects beyond it. In some embodiments, the agitation device is a flexible ribbon that is forced to vibrate by the air passing over it. As the chassis plate, and thus also the nozzle and plough, is advanced along the gutter, the plough lifts debris and the vibrating tip and body of the ribbon agitates the debris so it can be easily blown out of the gutter.

The chassis plate locates the nozzle, the ribbon, and the plough at the correct height and angle of inclination to the gutter and positions the nozzle generally over the center of the gutter. In addition, the chassis plate also bears the weight of the device on the top edge surface of the gutter, thereby relieving the operator of continuously having to maintain these spatial relationships as well as having to support the full weight of the apparatus in use or at rest.

The chassis plate supports the nozzle at an angle in relation to the gutter that directs the debris away from the operator's head and eyes and mouth.

In some embodiments, friction between the chassis plate and the top edge surface of the gutter helps to stabilize the upper end of the gutter cleaning device, which is a long apparatus, so as to help prevent the device from falling sideways or backwards away from the gutter under the influence of gravity.

In other embodiments, a gutter-facing surface of the chassis plate includes a low-friction material to facilitate movement of the gutter cleaning device along the gutter.

The plough is a generally wedge-shaped member in order to lift the debris into the air stream from the nozzle outlet so that it can be blown from the gutter and away from the operator as (s)he walks parallel with, and advances the gutter cleaning device along, the gutter.

The curved profile and orientation of the plough relative to the gutter helps to lift, and then drop, debris into the airstream so that it is more easily blown from the gutter.

The gutter cleaning device can also be used to clean a down spout portion of a gutter system by directing the plough down the top of a down spout by canting the fluid supply tube in the appropriate direction.

The nozzle is tapered to increase the speed of the air stream sufficiently to cause the flexible ribbon to vibrate: both air stream and ribbon then work in concert with the plough to scour the debris from the gutter.

In some embodiments, the fluid-driven agitation device is anchored within the nozzle outlet and projects outward beyond it. In other embodiments, the fluid-driven agitation device is anchored in front of the nozzle. As a result, the fluid agitation device is disposed in the flow path of high speed air exiting the nozzle. The fluid-driven agitation device is forced to agitate by the high speed air passing over it. For example, when the fluid agitation device is in the form of a ribbon, the ribbon flutters and vibrates. As the gutter cleaning device is then advanced along the gutter, the vibrating tip agitates the debris so that it can be blown out of the gutter by the air exiting the nozzle.

The fluid supply tube includes rigid, telescoping elements which provide an adjustable length fluid supply and cleaning head support structure. In addition, the orientation of the telescoping fluid supply tube can be set to a desired angle relative to the chassis plate to enable an operator to clean a gutter from the most convenient location below.

A proximity sensor checks that a clean gutter has been left behind the tool.

A tree jack may be attached to the rear of the gutter cleaning tool. The tree jack may be in the form of a claw that can be used to lift small trees out of the gutter during cleaning.

The gutter cleaning device is easy to use, economical to make, and has few moving parts.

The gutter cleaning device can be formed in whole or in part of plastic materials, and the non-conductive nature of such materials obviates the risk of electrical shock to the operator from inadvertent contact of the device with overhead power lines.

The gutter cleaning device is formed having a plane of symmetry whereby the device can be simply rotated 180 degrees about its fluid supply tube axis if one needs to clean the gutter in the opposite direction along the gutter.

Advantageously, the gutter cleaning device removes debris that is difficult to remove using air or water pressure alone. In particular, since the gutter cleaning device includes the plough to lift the debris into the air stream in combination with the vibrating ribbon to agitate the debris so that it can be blown out of the gutter by the air exiting the nozzle, the gutter cleaning device can address the particular challenge posed by heavy, wet, compacted debris filling a gutter.

Other objects and purposes of the invention, and variations thereof, will be apparent upon reading the following specification and inspecting the accompanying drawings.

DETAILED DESCRIPTION

Figure 1:
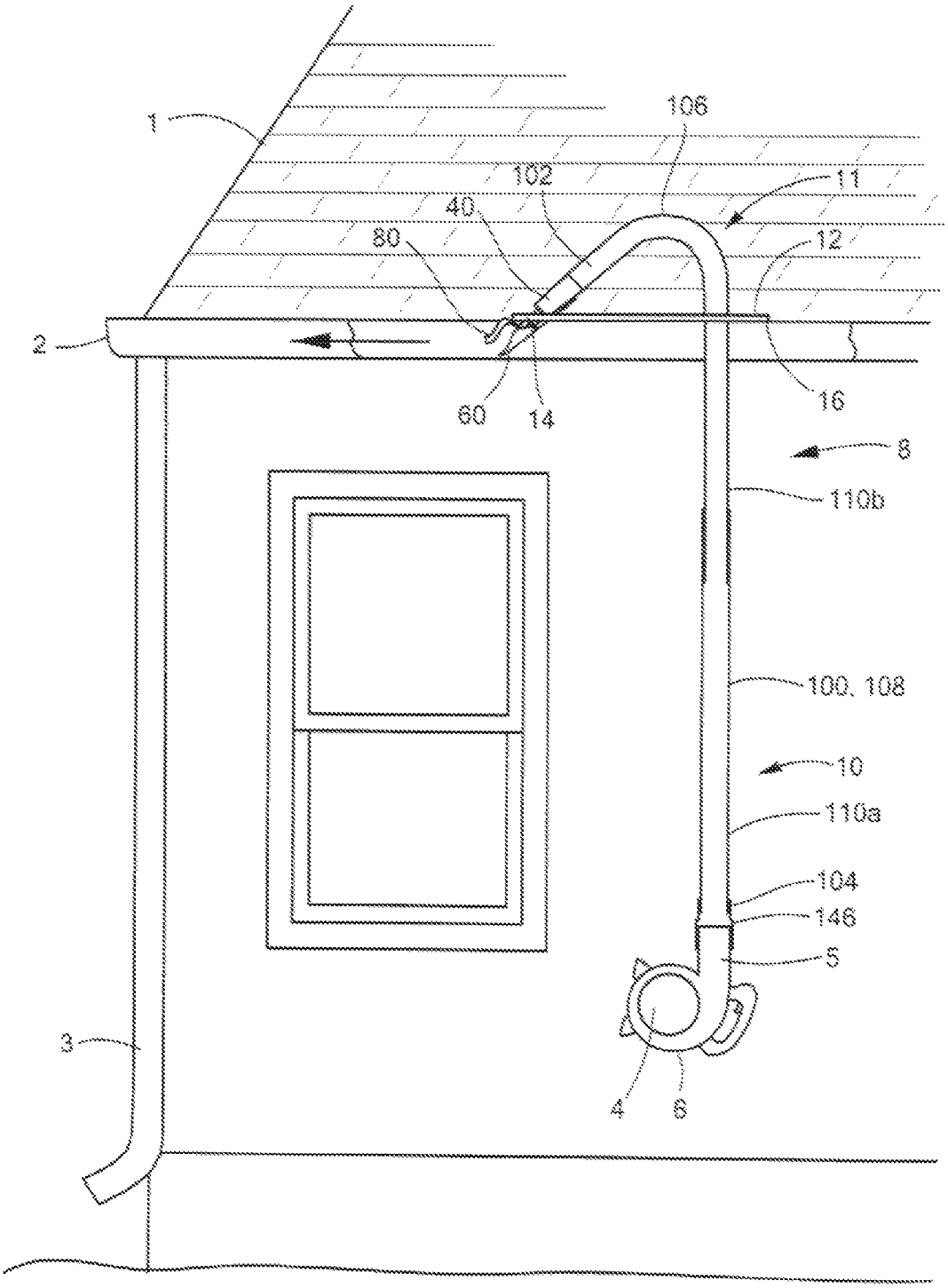
FIG. 1 is an illustration of the gutter cleaning device connected to a leaf blower, and in use within a gutter of a house. A portion of the gutter is shown partially cut away to illustrate the gutter cleaning device in use.
Figure 2:
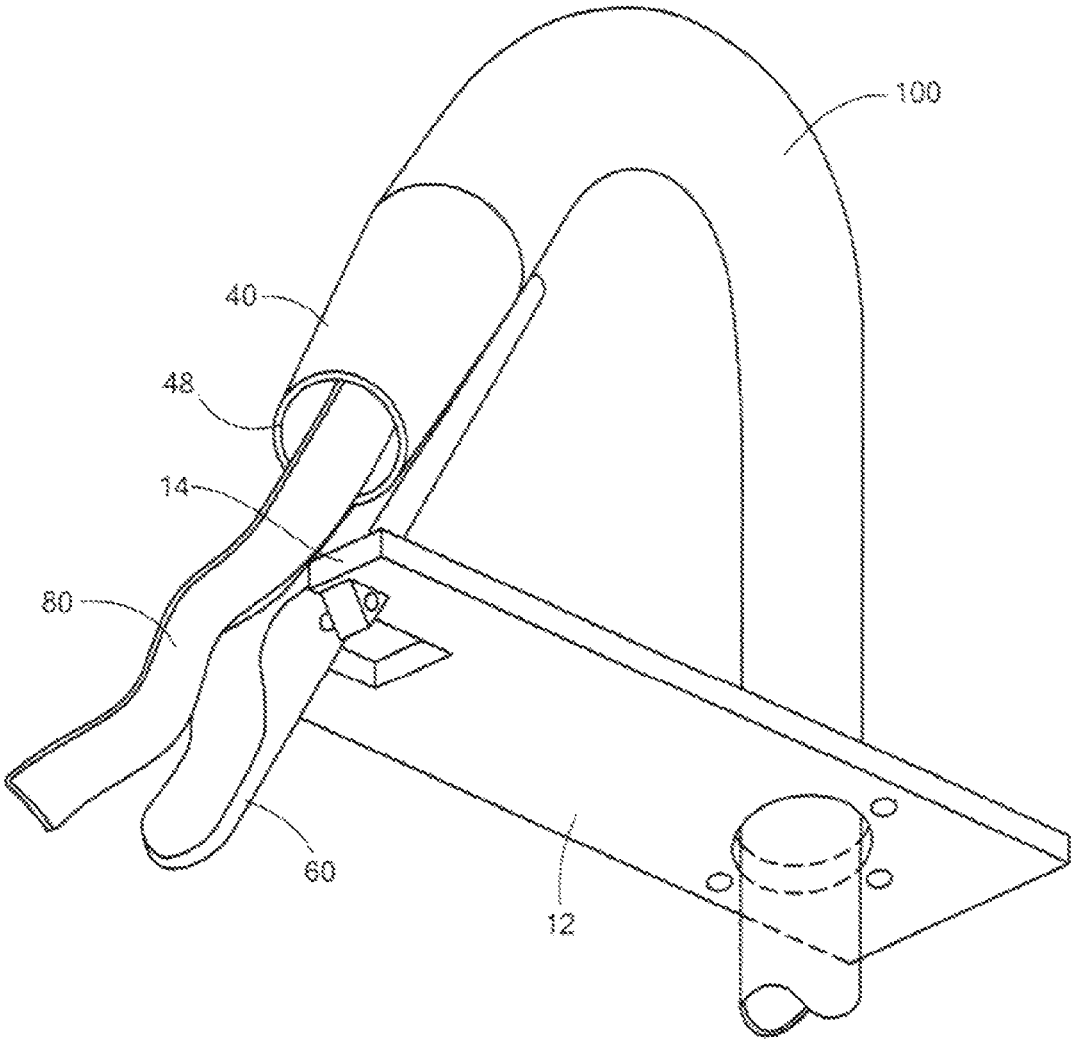
FIG. 2 is a front perspective view of an upper end of the gutter cleaning device.
Figure 3:
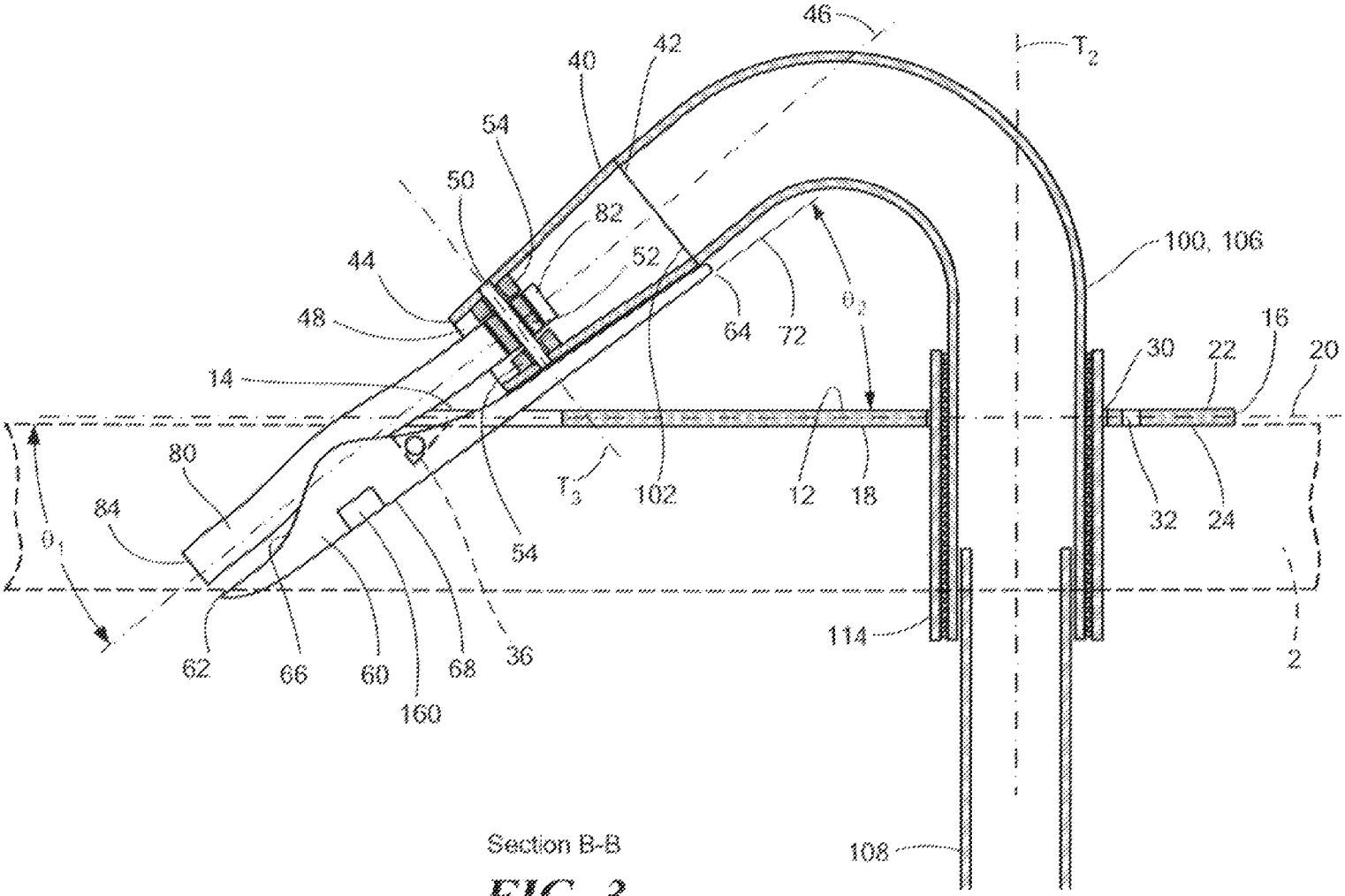
FIG. 3 is a side cross-sectional view of the upper end of the gutter cleaning device as seen along line B-B of FIG. 6.
Figure 4:
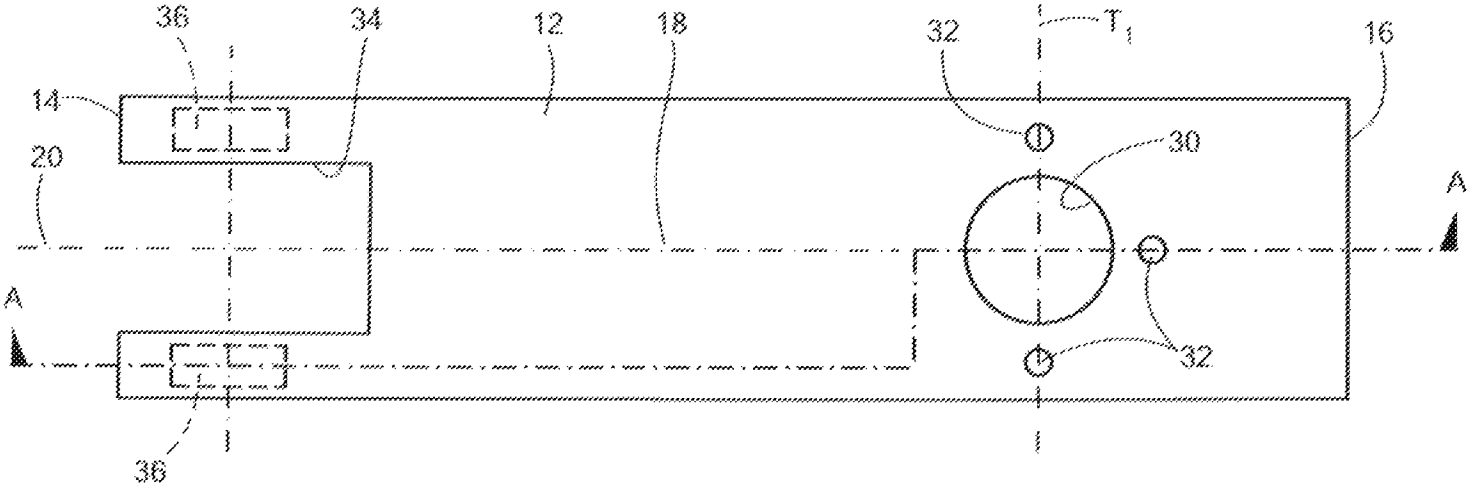
FIG. 4 is a top plan view of the chassis plate of the gutter cleaning device.
Figure 5:
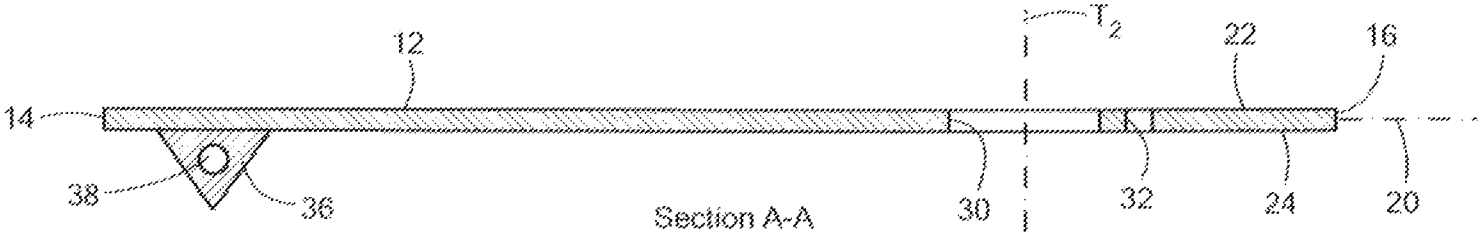
FIG. 5 is a side view of the chassis plate of FIG. 4 as seen along line A-A of FIG. 4.
Figure 6:
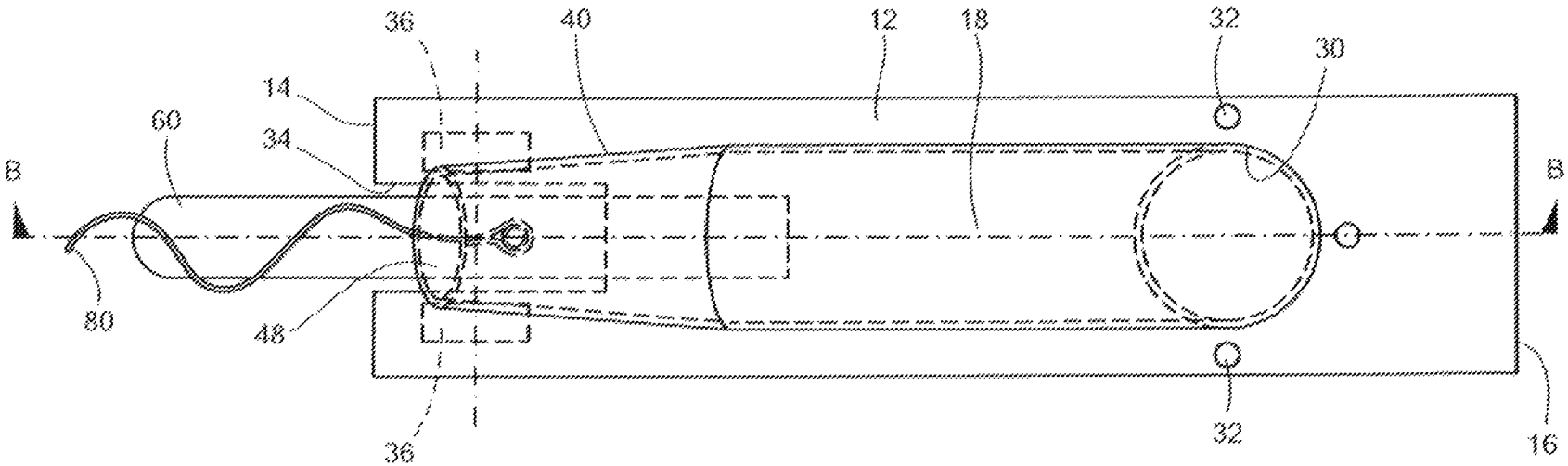
FIG. 6 is a top plan view of the upper end of the gutter cleaning device.

Referring to FIGS. 1-3, a gutter cleaning device 8 that can be used while standing on the ground to reach and clean gutters 2 and downspouts 3 at an overhead roof edge includes an upper portion that provides a cleaning head 11 and a lower portion 10 used to support and extend the cleaning head 11 above the operator. The lower portion 10 corresponds to a rigid, telescoping fluid supply tube 100 that can be connected to a source of pressurized air such as a leaf blower 6. The cleaning head 11 includes a chassis plate 12 that supports a nozzle 40 and a plough 60. The nozzle 40 is connected to an outlet end 102 of the fluid supply tube 100. The plough 60 extends from one end of the chassis plate 12 so as to be at least partially disposed in front of an outlet opening 48 of the nozzle 40. In addition, the cleaning head 11 includes a fluid-driven agitation device 80 that is anchored within the nozzle 40 and projects beyond it. The fluid-driven agitation device 80 is forced to agitate as pressurized air exits the nozzle and passes over it. As the chassis plate 12 is advanced along the gutter 2, the plough 60 lifts debris into the path of the fluid exiting the nozzle 40 and into the reach of the agitation device 80, which further agitates the debris so that the debris so it can be easily blown out of the gutter 2, as discussed further below.

The gutter cleaning device 8 is configured to be connected to a leaf blower gardening tool 6 or other source of pressurized air (shown schematically in FIG. 1). A leaf blower 6 is a home or gardening tool that propels air out of a discharge pipe to move yard debris, such as leaves, twigs, and the like. The leaf blower 6 may include a gasoline or electrically powered motor 4 that supplies high pressure air to a discharge pipe 5. As used herein, the term "leaf blower" refers to a self-contained mobile unit that can be hand-held, or carried in a backpack or on a wheeled cart. It may be a tool dedicated to blowing leaves, or alternatively may be a general use device such as an air compressor.

In what follows, the terms "forward" or "front" refer to positions adjacent a leading end 14 of the chassis plate 12, and the terms "rearward" or "behind" refer to positions adjacent a trailing end 16 of the chassis plate 12. In addition, a forward motion of the gutter cleaning device 8 is defined as the operator manually moving the gutter cleaning device 8 toward the front, and in the direction of and along the gutter to be cleaned and away from the section of the gutter that has already been cleaned. In FIG. 1, an arrow indicates the forward direction for the illustrated orientation of the gutter cleaning device. The debris cleaned from the gutter 2 will be carried by the forward-moving air stream emerging from the nozzle 40 in a direction away from the operator. This can be compared to some conventional devices which simply provide a 180 degree arcuate tube that, while still blowing debris from the gutter 2, will not blow it away from the operator standing below.

Referring also to FIGS. 3-7, when in use, the chassis plate 12 rests on the upper edge portions of the gutter 2, and provides a support structure for the other elements of the cleaning head 11. The chassis plate 12 has a longitudinal axis 20 that extends between the leading end 14 and the trailing end 16. The chassis plate 12 is elongated along the longitudinal axis 20 and includes a planar, gutter-facing surface 24 and an opposed, planar, outward-facing surface 22. In addition, the chassis plate includes a first transverse T1 axis (FIG. 4) perpendicular to the longitudinal axis 20 that is aligned with a width, or lateral, direction of the chassis plate 12, and a second transverse axis T2 (FIG. 5) perpendicular to both the first transverse axis T1 and the longitudinal axis 20. The second transverse axis T2 is aligned with the thickness direction of the chassis plate 12, where the chassis plate thickness refers to the distance between the outward of the plough 60 facing surface 22 and the gutter-facing surface 24. In some embodiments, when seen in plan view, the corners of the chassis plate leading end 14 may be rounded to avoid snagging a gutter seam.

An opening 30 is provided in the chassis plate 12 between the trailing end 16 and a midpoint 18 of the chassis plate 12. The opening 30 extends between the gutter-facing surface 24 and the outward-facing surface 22, and is shaped and dimensioned to receive the fluid supply tube 100 therethrough in a fitted manner. In the illustrated embodiment, the fluid supply tube 100 has a circular cross-section, but the fluid supply tube 100 is not limited to this shape.

In some embodiments, a flexible, hollow support tube 114 may be disposed in the chassis plate opening 30 so as to surround the fluid supply tube 100 at this location. The support tube 114 is used to connect the chassis plate 12 to the fluid supply tube 100, and may include an embedded or outer coil spring (not shown). The support tube 114 including the coil spring provides resiliency and can help restore the starting neutral orientation of the fluid supply tube 100 relative to the chassis plate 12 when no force is applied to either body, as discussed further below.

In addition, the chassis plate 12 includes three through holes 32 arranged about a circumference of the opening 30. The through holes 32 extend between the gutter-facing surface 24 and the outward-facing surface 22, and each has a diameter that is small relative to that of the opening 30. In the illustrated embodiment, the chassis plate 12 includes a through hole 32 on opposed lateral sides of the opening 30, and a third through hole 32 between the opening and the trailing end 16. The through holes 32 are configured to receive control lines 150 that control an angle of the fluid supply tube 100 relative to the chassis plate 12, as discussed further below.

The leading end of the chassis plate 12 includes a cutout 34 that receives a portion of the plough 60. In some embodiments, brackets 36 are provided on the gutter-facing surface 24 on opposed lateral sides of the cutout 34. The brackets 36 support a pin 38 that secures the plough 60 to the chassis plate 12.

The chassis plate 12 serves as a mounting plate or chassis to which other parts of the gutter cleaning device 8 are attached, and maintains the nozzle 40 and plough 60 at a predetermined height in relation to the bottom surface of the gutter when cleaning the gutter. For example, in some embodiments, the bottom of the nozzle 40 may be approximately 3.5 inches above the bottom surface of a standard U.S. house gutter, and the plough 60 may be positioned just above the gutter bottom surface. This plough position prevents the leading edge 62 of the plough 60 from snagging on an overlapped joint formed in the gutter bottom surface. In other embodiments, the plough 60 may be spaced apart from the gutter bottom surface for an initial cleaning pass, and then adjusted to be close to, or resting on, the gutter bottom surface for a subsequent cleaning pass.

The chassis plate 12 maintains a longitudinal axis 46 of the nozzle 40 at an angle θ1 with respect to the long axis of the gutter 2 once the chassis plate longitudinal axis 20 is parallel to the top edge surface of the gutter 2 and rests upon it or is slid along and parallel to it. The chassis plate 12 also holds the nozzle longitudinal axis 46 at a constant angle with respect to the long axis of the fluid supply tube 100 in a plane defined by the second transverse axis T2 and the chassis plate longitudinal axis 20. Hence the air flow from the nozzle 40 is directed into and forwardly along the gutter 2 so as to scour debris from the gutter 2, and thereby aiming the debris away from the operator.

Lateral margins of the chassis plate 12 support part or all the weight of the gutter cleaning device 8 on the top edge surface of the gutter 2. This is achieved by the operator placing the gutter-facing surface 24 in contact with the top edge surface of the gutter 2. Hence, once the nozzle 40 is placed in the proper location and attitude relative to the gutter 2 (discussed further below), the chassis plate 12 offloads the operator of maintaining them at that location and attitude, allowing the operator to only concentrate on sliding the elongate member forward along the top outer surface of the gutter to clean it. If the operator stops for a rest then the chassis plate 12 can support the entire weight of the gutter cleaning device 8 without the operator having to hold it. The lateral margins of the chassis plate 12 act as a sliding runner allowing the whole gutter cleaning device 8 slide along the top edge surface of the gutter 2 while bearing partial or complete weight of the apparatus.

The chassis plate 12 may include guide features (not shown). In some embodiments, a downward projection (not shown) may be located near the left and right lateral margins of the chassis plate 12. When the chassis plate 12 rests on the top edge surface of the gutter 2, one of these projections will bear on the outside surface of the top edge of the gutter so as to guide the leading edge 62 of the plough 60 along the centerline of the gutter 2 as the cleaning device 8 is moved forward. In other embodiments, a rubber or plastic roller (not shown), mounted on a stub axle (not shown), may project perpendicularly from the chassis plate 12. The roller would achieve the same purpose as each projection. In addition, the fore-aft location of the stub axle may be selectable, for example by placing the stub axle in the most advantageous of one of several axle-receiving holes (not shown) in the chassis plate 12.

Since the chassis plate 12 bears the partial weight of the gutter cleaning device 8 on its lateral margins, this bearing also causes a friction force between the chassis plate 12 and the gutter 2 that opposes its motion forward or backward along the gutter 2 as well as outward away from the dwelling. This friction force helps the operator balance and stabilize the otherwise top-heavy device 8 above him/her on the gutter 3. In addition, the friction force counteracts the rearward force created by the air exiting the nozzle 40.

The chassis plate 12 serves as a platform upon which bending moments can be applied to the chassis plate 12. For example, in some embodiments, one or more adjustment lines 150 extend between the chassis plate 12 and the fluid supply tube 100 to permit adjustment of the angle of the fluid supply tube 100 relative to the chassis plate 12, as discussed in detail below.

The chassis plate 12 has left-right symmetry that permits the direction of forward cleaning of a gutter to be reversed by 180 degrees, in plan view, simply by twisting the rigid fluid supply tube 100 and chassis plate 12 through 180 degrees in a plane defined by the first transverse axis T1 and the chassis plate longitudinal axis 20. The contralateral lateral margin of the chassis plate gutter-facing surface 24 is then brought into contact with the same top edge surface of the gutter 2, and then slid along the gutter 2 in the opposite direction. This is sometimes useful for cleaning out obstinate debris. Hence the gutter cleaning device 8 can be used in either direction along a gutter 2 depending on the preference of the operator.

The chassis plate 12 advantageously allows the operator to position the nozzle 40 and/or the plough 60 within the gutter 2 such that the chassis plate 12 cannot slip off the gutter 2 in a direction normal to the length of the gutter 2 and away from the building 1, whenever the operator is using the gutter cleaning device 8 or rests or leaves the device 8 hanging on the gutter.

Figure 7:
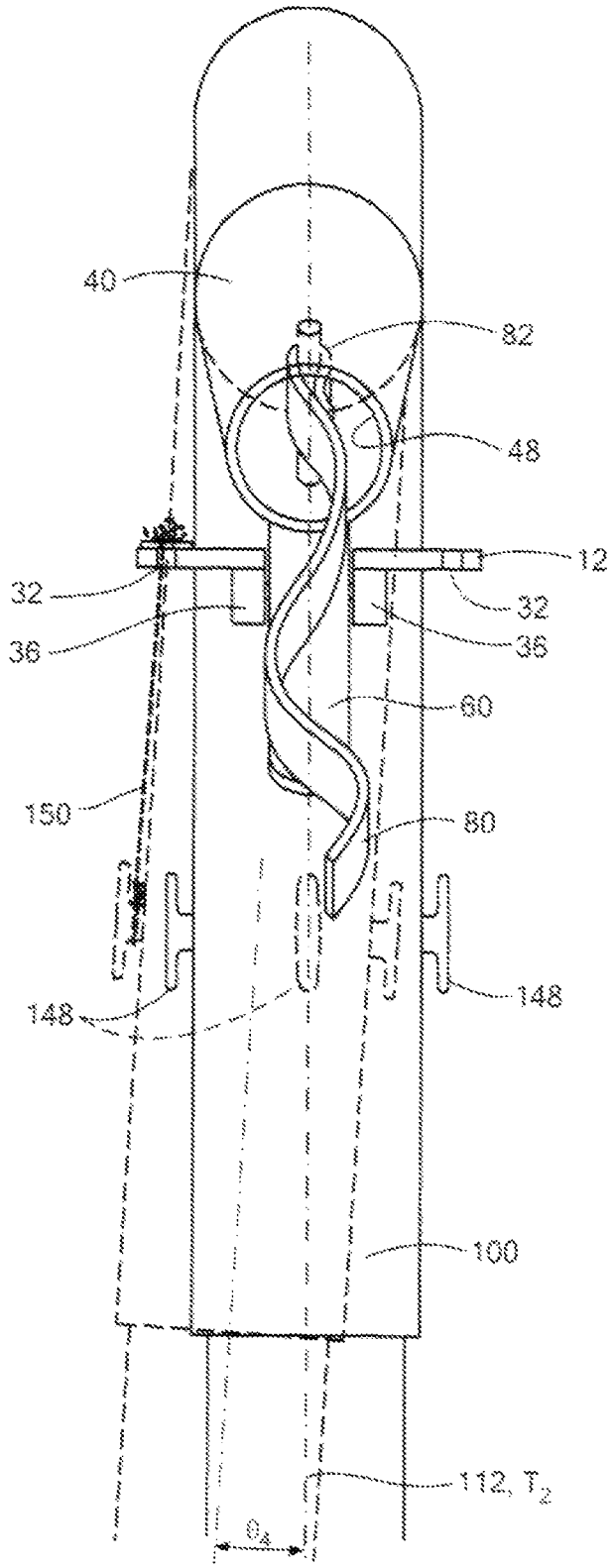
FIG. 7 is a front elevation view of the upper end of the gutter cleaning device.

Referring to FIGS. 1, 3 and 7, the fluid supply tube 100 is held upright by the operator when using the gutter cleaning device 8 to clean the gutter 2, and supports the cleaning head 11 above the operator. In addition, the fluid supply tube 100 is a conduit that directs pressurized air to the nozzle 40. To that end, the fluid supply tube 100 has an outlet end 102 connected to the nozzle 40, and an inlet end 104 opposed to the outlet end 102. The inlet end 104 is configured to be connected to a fluid supply source such as the leaf blower 6, for example via an adaptor 146 that is, in turn, configured to provide a fluid-tight connection to the leaf blower discharge pipe 5 while accommodating leaf blower discharge pipes 5 of various sizes and shapes. In the illustrated embodiment, the adaptor 146 is a collar-like coupling. In other embodiments, the adaptor 146 may be a length of flexible tube (not shown) that is interposed between the leaf blower discharge pipe 5 and the inlet of the fluid supply tube 110 to permit the orientation of the leaf blower 6 to be varied relative to the supply tube 110. This would be needed if the leaf blower 6 is to be worn on the operator's back, for example. The fluid supply tube 100 also includes a first intermediate portion 106 in the form of a curved flexible tube that extends between the outlet end 102 and the chassis plate opening 30, and a second intermediate portion 108 that extends between the first intermediate portion 106 and the inlet end 104.

The second intermediate portion 108 is disposed on the gutter-facing side of the chassis plate 12, and includes two or more rigid, telescoping elements 110*a*, 110*b* whereby the length of the second intermediate portion 108 is adjustable. Cleats 148 are disposed on the outer surface of the second intermediate portion 108 at a location spaced apart from the chassis plate gutter-facing surface 24. A cleat 148 is provided on each lateral side of the second intermediate portion 108, and on a rearward side of the second intermediate portion 108 in correspondence with the through holes 32 of the chassis plate. The cleats 148 serve as anchors for fixing adjustment lines 150 to the second intermediate portion 108, as discussed further below.

The nozzle 40 has a first end 42 that is connected to the fluid supply tube outlet end 102, an opposed second end 44 that defines the nozzle opening 48, and a centerline that defines a nozzle axis 46 that is concentric with the nozzle first and second ends 42, 44. The nozzle 40 is a tube that tapers inward from the first end 42 to the second end 44 to increase the speed of the air as it passes through the nozzle 40. The significance of the air speed will become apparent in the discussion of the fluid-driven agitation device 80, described below. The supply line outlet end 102 and the nozzle first end 42 are larger in diameter than the nozzle opening 48 in order to reduce frictional losses as air flows along the fluid supply tube 100 to the nozzle 40. The nozzle second end 44 is secured to the leading end 14 of the chassis plate 12 such that the nozzle axis 46 is acutely angled relative to the chassis plate longitudinal axis 20. In some embodiments, the nozzle 40 is fixed to the chassis plate 12 such that the angle θ1 between the nozzle axis 46 and the longitudinal axis 20 is in a range of 20 to 60 degrees. For example, an angle θ1 of 40 degrees has been shown to work well for removing debris, and also for directing debris forward and away from the operator.

The nozzle outlet opening 48 is narrower than the gutter 2 is wide at its base. In some embodiments the nozzle outlet opening 48 may be circular, whereas in others it may be ovoid, rectangular or some other shape.

The fluid-driven agitation device 80 is disposed at the forward end of the nozzle 40 and is configured to be driven by the high velocity fluid exiting the nozzle opening 48 in such a way as to facilitate removal of debris from the gutter 2. In the illustrated embodiment, the fluid-driven agitation device has the form of a ribbon 80.

In particular, the ribbon 80 is an elongate strip of flexible material, having a fixed end 82 secured within the nozzle 40 and a free end 84 opposed to the fixed end 82, where the free end 84 disposed outside the nozzle 40. The ribbon 80 is secured to an inner surface of the nozzle 40 so that the ribbon 80 is disposed in the path of a fluid stream exiting the nozzle opening 48. To this end, the nozzle 40 includes an axle 50 that extends between opposed inner surfaces of the nozzle 40 along an axis T3 transverse to the nozzle axis 46. In the illustrated embodiment, the axis T3 is parallel to a plane defined by the second transverse axis T2 and the longitudinal axis 20, but it is not limited to this orientation. The fixed end 82 of the ribbon 80 is rotatably secured to the axle 50 via a low-friction sleeve bearing 52. The sleeve bearing 52 is centered within the nozzle 40 via spacers 54 disposed between the bearing 52 and respective inner surfaces of the nozzle 40. Although alignment of the axle 50 along the axis T3 has been shown to work well, in other embodiments the axle 50 may be aligned so that when the device is in use it may be essentially vertical.

The ribbon 80 has a length that is defined as a distance between the fixed end 82 and the free end 84, a width that is smaller than a corresponding dimension of the nozzle opening 48, and a thickness that is small relative to the ribbon length and width. In some embodiments, the width of the ribbon 80 is about half the corresponding dimension of the outlet opening 48, and the length of the ribbon 80 is about ten times the dimension of the width.

The ribbon 80 is formed of strip of a durable, flexible, thin sheet material. For example, the ribbon 80 may be formed of rubber, a rubberized textile, nylon webbing, or other suitable thin, flexible material having sufficient toughness and wear properties.

The distal end of the ribbon 80 projects through the nozzle opening 48 and, importantly, beyond it. In use, the ribbon 80 is forced to vibrate by the pressurized air passing over it. For example, when air is forced to flow through the tapered nozzle 40, it reaches a critical speed that, when it flows along the ribbon 80, induces a fluttering motion of the ribbon 80. As a result, the free end 84 and the body of the ribbon 80 oscillate back and forth in a serpentine manner, like a flag fluttering in the wind. The resulting whipping or fluttering motion of the ribbon 80 agitates debris in the gutter, facilitating removal of the debris via the pressurized air stream. More specifically, one purpose of the ribbon 80 is to break up, and stir up, any wet, heavy or compacted debris lying in the bottom of the gutter 2 so that it enters the main air flow stream exiting from the nozzle 40 or is flicked laterally out of the gutter 2. Another purpose of the ribbon 80 is to prevent the debris from reaching, entering and clogging the nozzle outlet opening 48 as the nozzle 40 is pushed forward along the gutter 2 to clean it. The ribbon 80 prevents clogging because it removes the debris from the gutter 2 before it can reach the nozzle opening 48 to clog it. Advantageously, the ribbon 80 provides auditory feedback to the operator since the sound of the ribbon 80 in an empty gutter is quite different from that of the ribbon 80 in a debris filled gutter.

Figure 8:
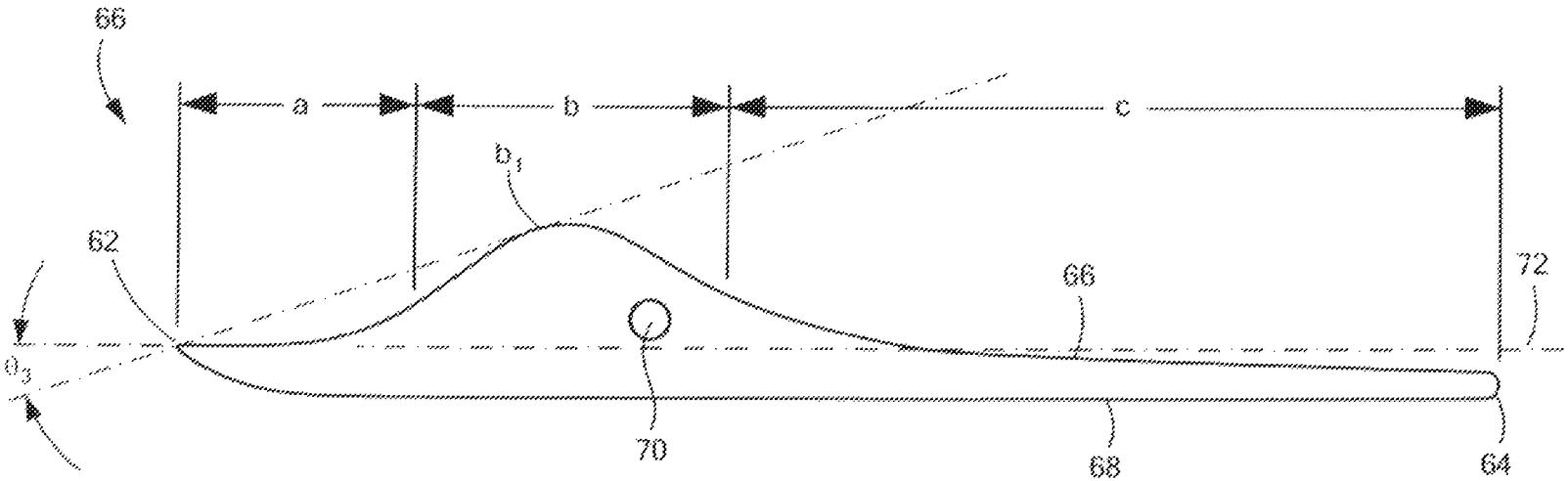
FIG. 8 is an isolated side view of the plough.
Figure 9:
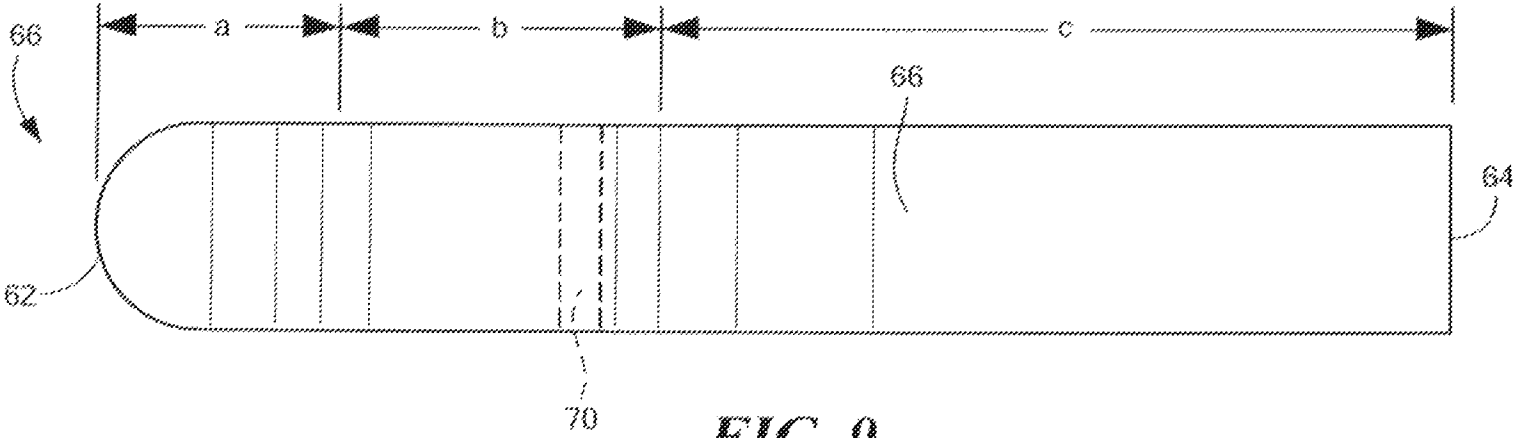
FIG. 9 is a top plan view of the plough.

Referring to FIGS. 3, 8 and 9, the plough 60 is an elongated, rigid or semi-rigid structure having a proximal end 64, and a distal tip 62 that is opposed to the proximal end 64. The proximal end 64 is fixed to the nozzle 40 so as to be disposed between the nozzle 40 and the chassis plate outward-facing surface 22, and the distal tip 62 is disposed on an opposed side of the chassis plate 12 relative to the proximal end 64.

An intermediate portion of the plough 60 extends through the cutout 34 formed at the leading end 14 of the chassis plate 12. The plough 60 includes a through hole 70 that is disposed closer to the distal tip 62 than the proximal end 64, and that receives a pin 38 that secures the plough 60 to the brackets 36 provided on the chassis plate 12 gutter-facing surface 24. The pin 38 extends in parallel to the first transverse axis T1.

In the illustrated embodiment, the distal tip 62 of the plough 60 has a sharp leading edge that curves upward when seen in side view (FIG. 8) and is rounded when seen in top view (FIG. 9). The upward curve of the distal tip 62 facilitates sliding of the plough 60 along an inner bottom surface of the gutter 2 when in use. In other embodiments, however, the plough distal tip 62 may be flat when seen in side view (not shown) and chisel-like (e.g., linearly tapered to a flat front edge) when seen in top view (not shown). In still other embodiments, the plough distal tip may be pointed so as to reduce the force needed to push it under, or into, compacted debris lying in the gutter 2.

A lower, or gutter-facing, surface 68 of the plough 60 is planar. The plough 60 is generally wedge-shaped in that the thickness of the plough 60 at the distal tip 62 is thin relative to the thickness of the plough between the distal and proximal ends 62, 64, where the plough thickness refers to the distance between an upper, or nozzle-facing, surface 66 of the plough 60 and the gutter-facing surface 68. The plough 60 includes a plough axis 72 corresponding to a straight line extending between the proximal end 64 and the distal tip 62.

The nozzle-facing surface 66 of the plough 60 has curvilinear shape that is configured to urge debris into the path of the fluid stream exiting the nozzle 40. In particular, the nozzle-facing surface 66 includes a convex portion b disposed between the proximal end 64 and the distal tip 62, a first concave portion a that extends between the convex portion b and the distal tip 62, and a second concave portion c that extends between the convex portion b and the proximal end 64. The first and second concave portions a, c are thin relative to the convex portion b. In addition, the length of the second concave portion c is about twice the length each of the first concave portion a and the convex portion b. In use, the second concave portion c of the nozzle-facing surface 66 abuts a chassis-facing surface of the nozzle 40, and the convex portion b is positioned in front of the nozzle opening 48 such that an apex b1 of the convex portion b is spaced apart from the nozzle opening 48 and is generally aligned with the nozzle axis 46. In some embodiments, the convex portion b is shaped and dimensioned such that a line passing between the distal tip 62 and the apex b1 lies at about a 30 degree angle θ3 relative to the plow axis 72 (FIG. 8).

In use, the plough 60 extends in front of the nozzle 40 and is arranged somewhat parallel to the nozzle axis 46. To this end, the plough 60 is disposed in the chassis plate cutout 34 so as to extend outward from the leading end 14. In addition, the plough 60 is arranged such that the plough axis 72 is angled relative to the longitudinal axis 20. In some embodiments, the plough 60 is fixed to the chassis plate 12 and/or nozzle 40 such that the angle θ2 between the plough axis 72 and the longitudinal axis 20 is in a range of 20 to 40 degrees (FIG. 3). For example, an angle θ2 of 30 degrees has been shown to work well.

When the gutter cleaning device 8 is pushed forward along the gutter 2, the curvilinear shaped upper surface 66 serves the following purposes: The distal tip 62, when pushed forward along the gutter, undercuts. loosens and lifts a portion of the debris in the gutter 2, by virtue of its being pushed forward along the gutter 2 by the operator. The leading portion of the curve of the convex portion b then lifts the debris from the bottom of the gutter 2 and directs it into the center of the air flow exiting the nozzle 40 that has the highest air speed, whereby the debris can be carried out of the gutter by the moving air, or be agitated by the ribbon 80, or both. Without the wedge action of the distal tip 62 and convex portion b of the plough 60, the flow of air into the gutter 2 may insufficient to reliably scour, lift and carry heavy, wet or compacted debris from the gutter 2. The trailing portion of the curve of the convex portion b allows the debris that has moved up along the wedge to the apex b1 of the convex portion b, by virtue of the plough 60 being pushed forward along the gutter 2, to fall into the moving air stream and thence be carried along and out of the gutter 2.

The wider the plough 60, the more force is required to drive it under the consolidated debris. It has been determined that a ratio of plough width to gutter width of about 1:3 works well, and does not require more than a few pounds of force to drive it forward into heavy compacted debris. For example, in a gutter 2 having a width of about three inches, a plough width dimension of one inch has been found to work well.

In some gutter configurations including brackets or gutter nails, the plough 60, when located so as to project below the top surface of the gutter 2, will inevitably snag each gutter nail as it is pushed along the gutter 2, thereby stopping forward progress. In cash case, the plough 60 is simply backed up a distance greater than the horizontal projection of the distal tip 62 forward of the gutter nail, lifted to clear the gutter nail, moved forward over the top of the gutter nail, and lowered into the gutter 2 beyond the gutter nail to continue to cleaning debris from the gutter.

Referring to FIG. 7, adjustment lines 150 are provided to permit adjustment of the angle of the fluid supply tube second intermediate portion 108 relative to the chassis plate 12. The adjustment lines 150 (only one adjustment line 150 is shown) pass through each of the through openings 32 of the chassis plate 12, and are secured at one end to the chassis plate outward facing surface 22. When the adjustment lines 150 are not used, the second intermediate portion 108 extends in a direction normal to the chassis plate 12 and parallel to the second transverse axis T2 that is concentric with the supply line-receiving opening 30. When the second intermediate portion 108 has been positioned at a desired angle relative to the chassis plate 12 (and thus also the axis T2), one or more adjustment lines 150 are secured to a corresponding cleat 148 provided on the second intermediate portion 108 so as to retain the second intermediate portion at the desired angle. As previously discussed, the cleats 148 are connected to the second intermediate portion 108 at a location spaced apart from the gutter-facing surface 24 of the chassis plate 12. In use, the adjustment lines 150 position the fluid supply tube such that the inlet end 104 of the fluid supply tube is spaced apart from the second transverse axis T2. As a result, the second intermediate portion 108 can be set at an angle θ4 relative to the second transverse axis T2. For example, the second intermediate portion 108 is adjustable between a first position in which a centerline 112 of the second intermediate portion 108 is coincides with the second transverse axis T2, and a second position in which the centerline 112 of the second intermediate portion 108 is angled relative to the second transverse axis T2.

Angling of the fluid supply tube 100 permits an operator to reach a second story gutter by reaching across a first floor porch, roof or shrub by inclining the fluid supply tube 100 to the vertical while still maintaining the chassis plate 12 in a generally horizontal orientation and in contact with, and parallel to, the top edge surface of the gutter 2. In some embodiments, each cleat 148 may be replaced by a linear servo motor configured to control the length of the corresponding adjustment line 150. This feature would allow the angulation of the chassis plate 12 to the fluid supply tube 100 to be remotely power adjusted.

As previously discussed, the support tube 114 including the coil spring provides resiliency that biases the fluid supply tune 100 to return to the neutral orientation (e.g., aligned with the transverse axis T2) relative to the chassis plate 12 when no force is applied to either body via the operator-actuated adjustment lines 150.

Referring again to FIG. 3, the gutter cleaning device 8 may include one or more devices 160 to sense the presence of debris inadvertently left behind in the gutter 2 after cleaning. The sensing devices may include one or more of an optical sensor, an ultrasound sensor, a camera, and a mirror. For example, a sensing device such as a camera located inside the nozzle 40 would provide a forward view of the gutter 2 while being protected from debris back splatter by the forward-moving air stream. In some embodiments, the proximity sensor 160 may be mounted on the plough gutter-facing surface 68 so as to be directed rearward along the gutter 2. In the case of an ultrasound sensor, if the reflected wave is weak or absent this means the gutter 2 is clean since the only reflected signal would be expected to be weak as it reflects off gutter nails, which are spaced several feet apart, and the edges of overlapping asphalt shingles or shakes overhanging part of the gutter 2. However, a strong reflected wave would indicate debris within the measurement distance. The feedback to the operator could be via any sensory modality, whether vibratory, auditory or visual. Alternatively, the feedback could be digital in the form of the presence or absence of a signal, or analog in terms of strength of the signal. Feedback may be provided to the operator via a display unit mounted on the fluid supply tube 100, or via a wireless signal delivered to a display of a personal mobile device such as a smart phone. In some embodiments, the display or smart phone may be mounted on the fluid supply tube 100 at a location above the operator's head.

Figure 10:
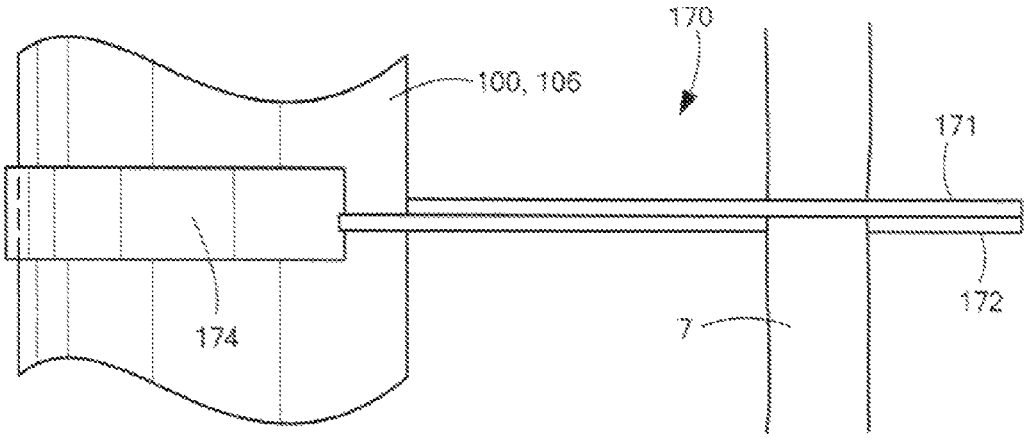
FIG. 10 is a side view of the tree claw.
Figure 11:
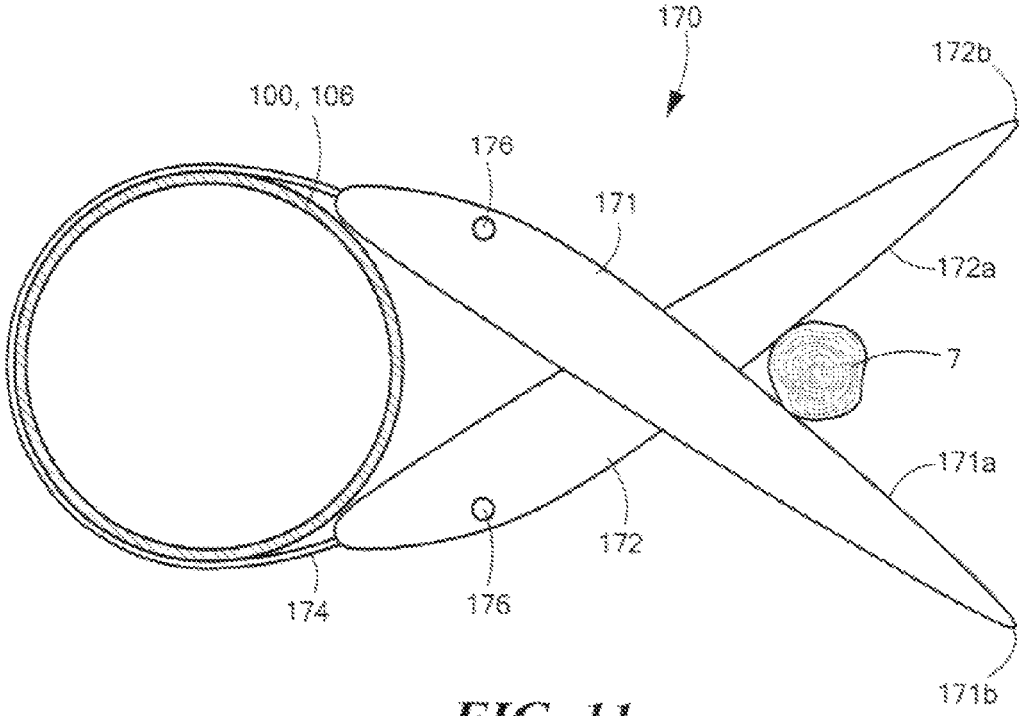
FIG. 11 is a top plan view of the tree claw.

Referring to FIGS. 10 and 11, the gutter cleaning device 8 may include a vee-shaped tree jack 170 mounted to the fluid supply line first intermediate portion 106 at a location adjacent to the chassis plate 12. For example, in some embodiments, the tree jack 170 is disposed adjacent to the chassis plate outward facing surface 22 and extends rearward within a plane defined by the first transverse and longitudinal axes T1, 20. The tree jack 170 resembles a boot jack or the claw of a claw hammer. It has thus two arms or blades 171, 172 oriented in a vee configuration in a plane generally parallel to the chassis plate outward facing surface 22, and extending in the trailing direction. Each of the two blades 171, 172 has a sharpened inner edge 171*a*, 172*a* in the manner of the claw of a claw hammer. The proximal end of each blade 171, 172 is attached to the end of a half-annulus spring member 174 attached to and surrounding the fluid supply tube 100. Alternatively, the spring member 174 may be attached to the chassis plate trailing end 16 (not shown). In some embodiments, the spring 174 may have a thin rectangular cross-section, but in other embodiments it could have circular or ovoid cross-sections. The purpose of the spring 174 is to maintain the two blades 171, 172 of the vee at a given angle to one another, but to allow the blades 171, 172 to spring apart slightly so as to accommodate large tree trunks 7 while gripping them via the closing spring force. The lips 171*b*, 172*b* of the blades 171, 172 should be rounded to mitigate risk of a stabbing injury.

When the tree jack 170 is pushed along the gutter 2, the sharp edges and vee-configuration of the blades 171, 172 can be used to snag the vertical trunk 7 of a small tree growing in the gutter 2. When the gutter cleaning device 8 is then lifted, the tree jack 170 then lifts the tree and its roots from the gutter 2. Shaking the tree jack 170 allows the tree to break loose and drop to the ground.

In some embodiments, the tree jack 170 includes holes 176 formed in the base of each blade 171, 172, allowing a "Y-shaped" cord (not shown) attached to the holes 176 to be pulled by the operator to twist the blades 171, 172 downwards to release the tree from the grasp of the tree jack 270. In one embodiment, the two blades 171, 172 of the tree jack 270 may be curved upwards in the manner of the claw of a claw hammer. This allows an operator to pry the tree from the gutter 2 as the blades 171, 172 are rolled along the top surface of the gutter by angling the vertical fluid supply tube 100 relative to the vertical.

The gutter cleaning device 8 removes wet or dry debris in the gutter after being attached to the leaf blower 6, and is designed to be used while standing on the ground to reach and clean gutters and downspouts at the first, second and even third story level without the need for a ladder. The gutter cleaning device 8 is advantageous relative to some conventional gutter cleaning devices that include a rigid tube to vacuum or blow leaves from a gutter since it includes the fluid-driven agitation device 80 powered simply by air pressure to mechanically stir up heavy debris in the gutter or to prevent the debris from clogging the orifice of the tube nearest the gutter. In addition, the gutter cleaning device 8 includes the plough 60 that mechanically lifts compacted debris in the gutter to be blown by the same flow of air that is used to drive the agitation device 80. Finally, the nozzle 40 is arranged at an angle to the gutter 2 so that the flow of air drives debris in a direction purposely away from the operator.

As previously discussed, since the chassis plate 12 rests on the top edge surfaces of the gutter 2, a friction force may be generated between the chassis plate 12 and the gutter 2 that opposes its motion forward or backward along the gutter 2 as well as outward away from the dwelling. Although this friction force helps the operator balance and stabilize the otherwise top-heavy device 8 above him/her on the gutter 3, in some cases it may be advantageous to reduce this friction force in order to facilitate movement of the gutter cleaning device 8 along the gutter 2. To this end, in some embodiments, the gutter-facing surface 24 is formed of a low-friction material that will reduce the force required to push the apparatus along the gutter 2. For example, the gutter-facing surface 24 may be formed of or coated with a mohair-like material such as can be used on no-wax skis, a Teflon-like material, or other suitable material.

Figure 12:
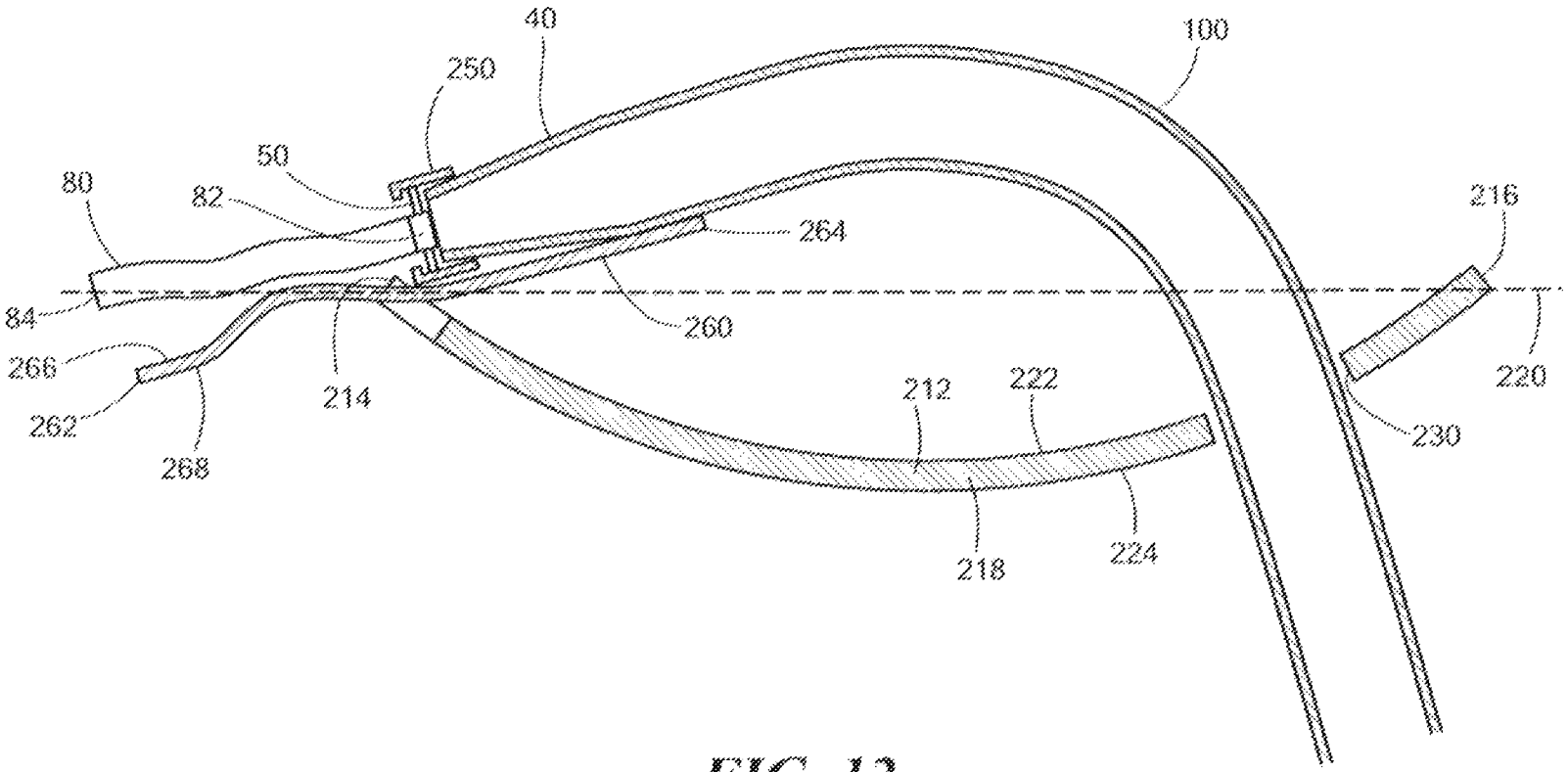
FIG. 12 is a side view of an upper end of an alternative embodiment gutter cleaning device.

Although the chassis plate 12 is illustrated in FIGS. 1-7 as being a flat plate, the chassis plate 12 is not limited to being flat. For example, as shown in FIG. 12, an alternative chassis plate 212 can be employed that is curved such that the gutter facing surface 224 of the chassis plate 212 is convex when seen in side view such that the midpoint 218 does not reside on a line 220 passing through the leading and trailing ends 214, 216 of the chassis plate 212. By providing a curved chassis plate 212, the angle of the nozzle axis 46 relative to a line defined by an upper edge of the gutter 2 can easily be adjusted by rocking the cleaning head 11 along the gutter facing surface 224 of the chassis plate 212, and thus the angle of attack and height relative to the gutter bottom of the supplied fluid and plough 60, 260 can also be easily adjusted. For extremely dense debris, this would allow an operator to remove the debris, layer by layer, with successively deeper passes along the gutter 2 relative to its bottom surface.

Figure 13:
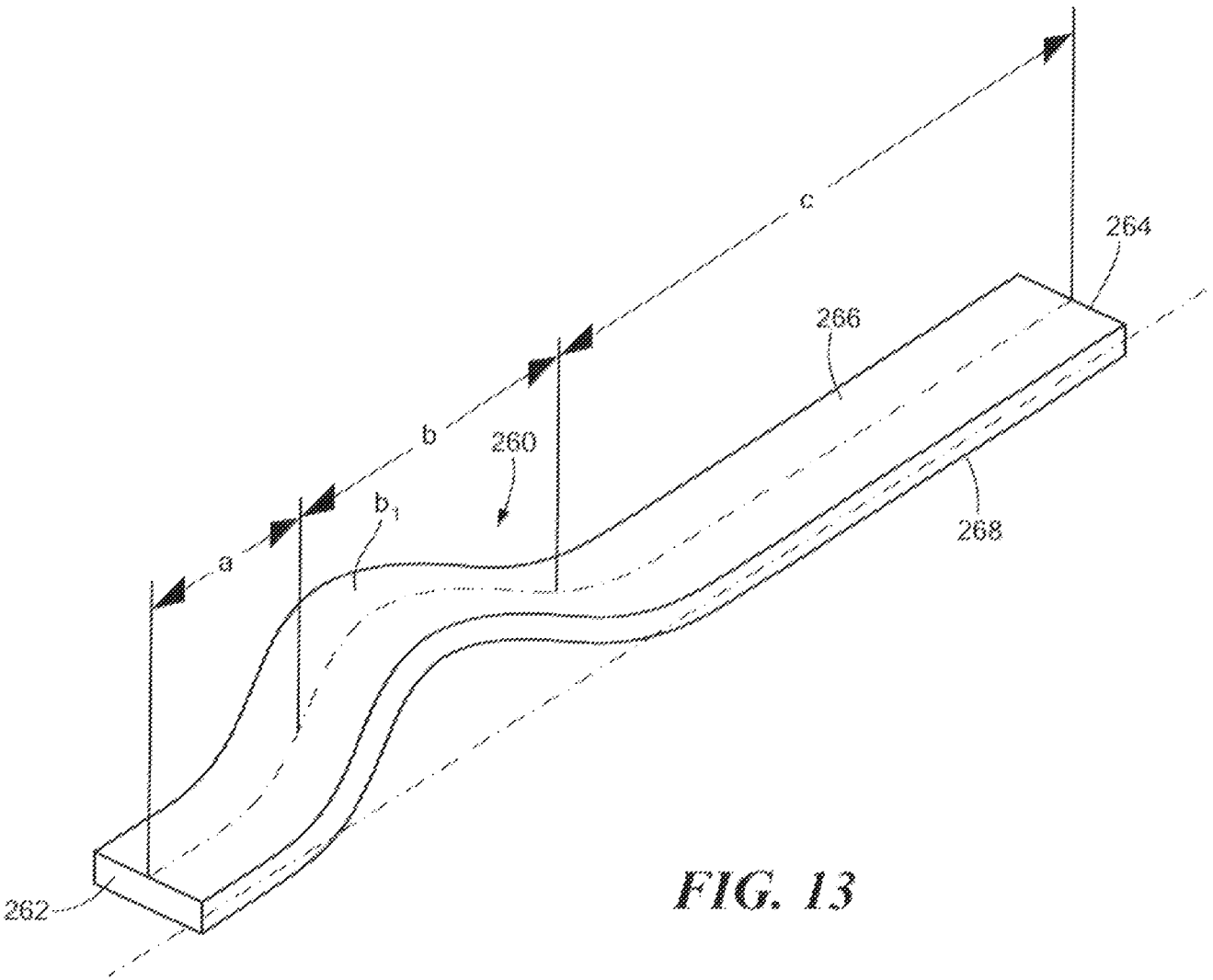
FIG. 13 is a perspective view of an alternative embodiment plough.

Although the plough 60 is illustrated in FIGS. 3 und 8 as being generally wedge-shaped, the plough is not limited to having a wedge shape. For example, as shown in FIGS. 12 and 13, an alternative plough 260 has a uniform thickness. However, the general shape of the plough's nozzle-facing surface 266 is unchanged relative to the earlier embodiment. That is, the nozzle-facing surface 266 includes a convex portion b disposed between the proximal end 264 and the distal tip 262, a first concave portion a that extends between the convex portion b and the distal tip 262, and a second concave portion c that extends between the convex portion b and the proximal end 264.

In the illustrated embodiments, the nozzle 40 is fixed to the leading end 14 of the chassis plate 12. However, the nozzle 40 is not limited to this configuration. For example,, in some embodiments, the angular orientation of the nozzle 40 relative to the chassis plate 12, 212 may be adjustable.

In some embodiments, the nozzle 40, the fluid supply tube 100, and the plough 60, 260 are formed as individual elements that are assembled together with the chassis plate 12, 212. In other embodiment, one or more of the nozzle 40, the fluid supply tube 100 or portions thereof, and the plough 60, 260 may be formed as a single element, for example by a molding process.

In some embodiments, the tapered nozzle 40 may be replaced by a Venturi tube whereby the reducer nozzle flares out again after reaching its minimum diameter, or alternatively, by a cylindrical tube having an interior orifice plate, or by another suitable structure that serves to increase the speed of the air passing through the nozzle opening 48 relative to that entering the nozzle inlet end 42.

Although the ribbon 80 is described herein as being at least partially disposed within the nozzle 40, the ribbon 80 is not limited to this configuration. For example, as shown in FIG. 12, the fixed end 82 of the ribbon 80 may be secured outside of the nozzle in such a way as to be disposed in the path of the fluid stream exiting from the nozzle opening 48. In some embodiments, the fixed end 82 is secured to the axle 50, which in turn is supported on an annular fitting 250 mounted on the nozzle small diameter end. Although the ribbon 80 is disposed entirely outside the nozzle 40, it is still centered within the fluid stream exiting from the nozzle opening 48, and is caused to vibrate by the fluid stream. In other embodiments, the fixed end 82 is instead secured to a stub axle projecting from the plough nozzle-facing surface 66 outside the nozzle and more or less perpendicularly to the plough axis 72.

Although the fixed end 82 of the ribbon 80 is described herein as being secured to the axle 50 via a bearing 52, the ribbon 80 is not limited to this configuration. For example, in some embodiments, the bearing 52 is omitted and the fixed end 82 is secured directly to the axle 50. In some embodiments, the fixed end 82 is formed in a loop that surrounds the axle 50, whereby the fixed end 82 is pivotable about the axle 50. In other embodiments, the fixed end 82 is fixedly secured to the axle 50, and the axle 50 rotates relative to the nozzle 40. In still other embodiments, the fixed end 82 is fixed to the axle 50, and the axle 50 is fixed relative to the nozzle 40.

Figure 14:
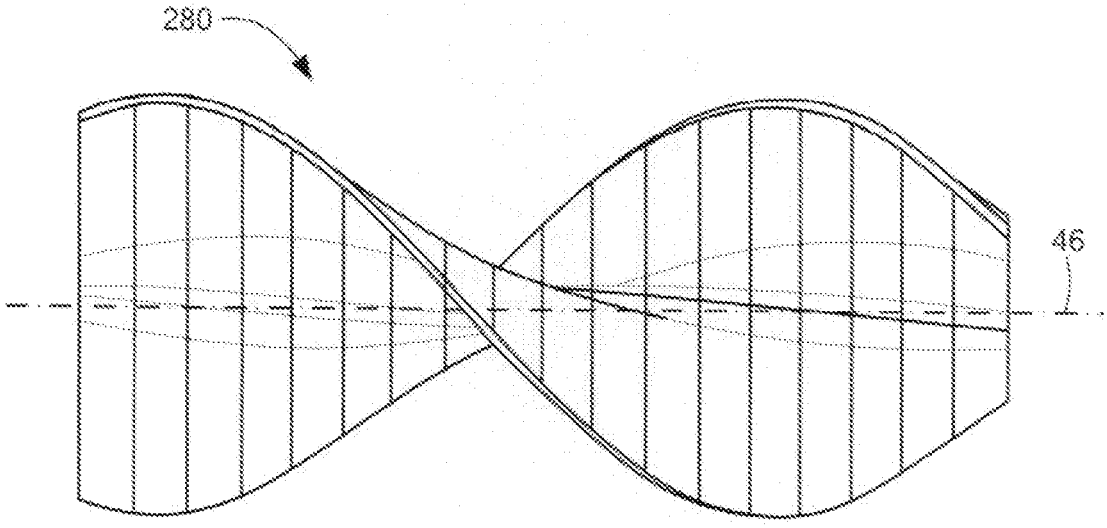
FIG. 14 is a side view of an alternative agitation device having a helical air-driven blade.
Figure 15:
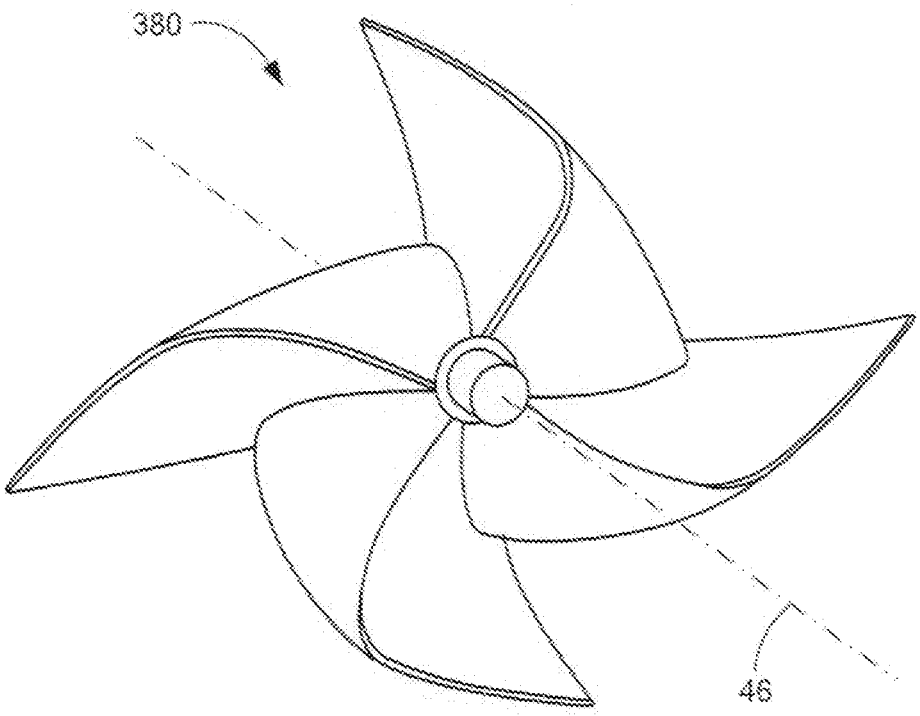
FIG. 15 is a front perspective view of an alternative agitation device having air-driven pin wheel-bladed vanes.
Figure 16:
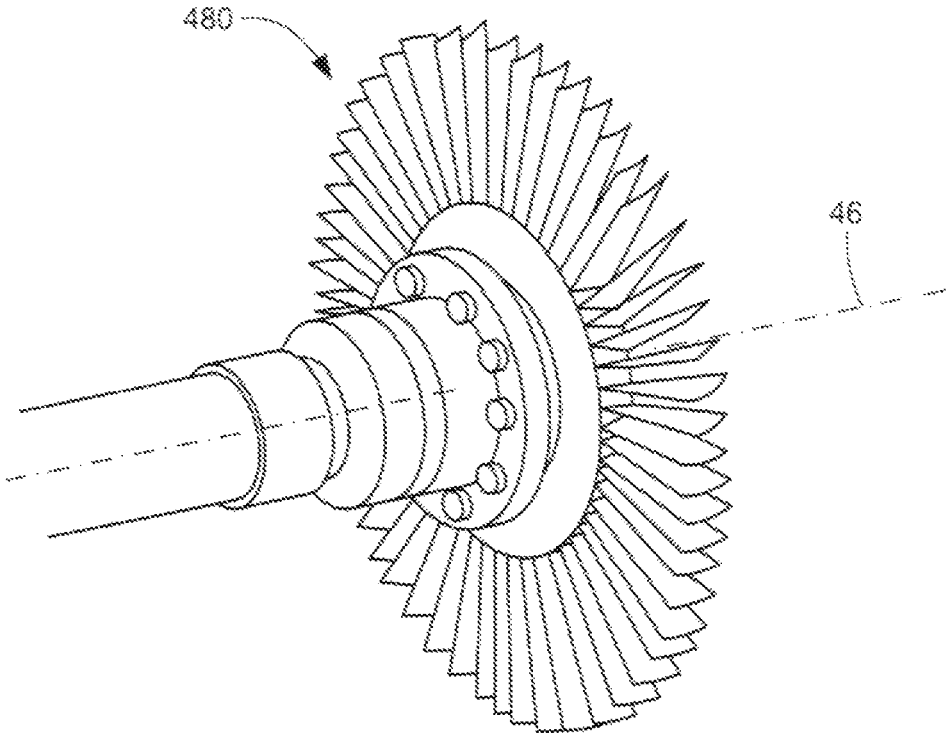
FIG. 16 is a rear perspective view of another alternative agitation device having flexible, radially-extending, air driven vanes.

Although the fluid-driven agitation device 80 is illustrated in FIGS. 1-3 and 12 as being in the form of a ribbon, the fluid agitation device 80 is not limited to a ribbon configuration. As shown in FIGS. 14-16, the fluid-driven agitation device 80 can have other configurations which are moved (i.e., agitated, rotated, oscillated, etc.) via fluid flow over outer surfaces thereof. For example, FIG. 14 illustrates an alternative fluid-driven agitation device 280 having a helically-shaped air-driven blade, FIG. 15 illustrates another alternative an alternative fluid-driven agitation device 480 having air-driven pin wheel-bladed vanes, and FIG. 15 illustrates yet another alternative fluid-driven agitation device 380 having flexible, radially-extending, air driven vanes.

Although the fluid supply tube 100 has been described herein as providing an adjustable length via rigid telescoping elements 110*a*, 110*b*, the fluid supply tube 100 is not limited to this configuration. For example, in some embodiments, the fluid supply tube 100 may be formed of a flexible pipe attached to a rigid pole.

It is possible to attach a curved sled runner to the front of the chassis plate 12 to have the plough 60 automatically ride up and over a gutter nail as the gutter cleaning device 8 is pushed forward along the gutter 2. This would obviate having to lift the gutter cleaning device 8 over each gutter nail. However, such a curved runner (which would resemble how the runners on a toboggan curve upward at the front) would interact with debris in the gutter 2 to adversely affect the function of the plough 60, 260 and agitation device 80. It would also leave sections of the gutter uncleaned under the gutter nails. It is contemplated to provide a cord (not shown) which could be pulled by the operator to retract the plough 60, 260 when a gutter nail is felt. If the nozzle outlet opening 48 is set to be above the level of the gutter nails, then this would enable the chassis plate 12 and gutter cleaning device 8 to ride over the gutter nails on the top edge of the gutter 2 without ever needing to lifting it over the gutter nails. A return spring (not shown) could redeploy the plough 60, 260 once the gutter nail is passed. In some embodiments, the plough 60 may be detachable from the chassis plate 12 and nozzle 40 for use of the cleaning head 11 when only loose, dry debris is to be removed from the gutter 2.

In some embodiments, the nozzle 40 can be replaced with a uniform diameter tube to provide a less expensive form of the gutter cleaning device 8. In some embodiments, the uniform diameter tube could have a smaller diameter than the diameter of the fluid supply tube 100, and the agitation device 80 and the plough 60, 260 would be mounted in the usual manner.

The gutter cleaning device 8 can accommodate gutters of various cross-sectional shapes. For example, it has been shown to work well in gutters of quadrilateral cross section which are common in North America, and will also work well in gutters that are semicircular in cross-section such as those found in Europe, Although the gutter cleaning device 8 has been described herein as employing pressurized air discharged from the nozzle 40, it is not limited to using pressurized air. For example, the gutter cleaning device 8 may be made to work using a vacuum instead of compressed air. To accommodate the vacuum, the shape and orientation of the plough 60 would stay the same, but the ribbon 80 would have to extend into the tapered nozzle 40 which itself would have to be turned through 180 degrees. Thus the nozzle inlet end 42 would be larger than the outlet opening 48, but still smaller in diameter than the gutter width. The ribbon 80 would be pivoted in the same manner about an upright axle. But a semi-rigid extension of the ribbon 80 would protrude from the inlet orifice of the inlet nozzle to act as the debris agitator in the gutter 2. The advantage of a vacuum-type gutter cleaning device would be that the gutter cleaning device 8 would not generate a mess of debris below the gutter. Such a mess may not be a problem if the ground below the gutter is grass or a border, but the mess may have to be swept up if it is a sidewalk or entryway.

Aspects described herein can be embodied in other forms and combinations without departing from the spirit or essential attributes thereof. Thus, it will of course be understood that embodiments are not limited to the specific details described herein, which are given by way of example only, and that various modifications and alterations are possible within the scope of the following claims.

What is claimed is:

1. A gutter cleaning device, comprising a chassis plate having a leading end, a trailing end and a longitudinal axis that extends between the leading end and the trailing end, the chassis plate being elongated along the longitudinal axis, a fluid supply tube that terminates in a nozzle, and a plough that extends outward from the leading end, wherein the nozzle includes an outlet opening disposed adjacent the leading end, and a centerline that defines a nozzle axis and is concentric with the outlet opening, the nozzle is secured to the chassis plate such that the nozzle axis is angled acutely relative to the longitudinal axis, and a nozzle-facing surface of the plough has a convex portion configured to urge debris toward the nozzle axis.

2. The gutter cleaning device of claim 1, wherein the plough has a uniform thickness.

3. The gutter cleaning device of claim 1, wherein the plough has a planar gutter-facing surface.

4. The gutter cleaning device of claim 1, wherein the plough has a proximal end connected to the chassis plate leading end, and a distal tip that is opposed to the proximal end, and a straight line extending between the proximal end and the distal tip is angled relative to the longitudinal axis.

5. The gutter cleaning device of claim 1, comprising a fluid-driven agitation device disposed in the path of the fluid stream exiting the nozzle.

6. The gutter cleaning device of claim 5, wherein the fluid-driven agitation device is an elongate strip of flexible material having a fixed end secured to the nozzle.

7. The gutter cleaner of claim 6, wherein the nozzle includes an axle that extends between opposed inner surfaces of the nozzle along an axis transverse to the nozzle axis, the fixed end of the elongate strip is rotatably secured to the axle via a bearing, and a free end of the elongate strip is disposed outside the nozzle.

8. The gutter cleaning device of claim 5, wherein the fluid-driven agitation device is a helically shaped member.

9. The gutter cleaning device of claim 1, wherein the fluid supply tube includes an outlet end connected to the nozzle, an inlet end opposed to the outlet end, the inlet end configured to be connected to a fluid supply source, a first intermediate portion that extends between the outlet end and the chassis trailing end, the first intermediate portion disposed on a first side of the chassis plate and defining a curved fluid path, and a second intermediate portion that extends between the first intermediate portion and the inlet end, the second intermediate portion disposed on a second side of the chassis plate and including telescoping elements whereby a length of the second intermediate portion in adjustable.

10. The gutter cleaner of claim 1, wherein the chassis plate includes a first transverse axis perpendicular to the longitudinal axis that is aligned with a width direction of the chassis plate, a second transverse axis perpendicular to the first transverse axis and the longitudinal axis, the second transverse axis being aligned with the thickness direction of the chassis plate, and an adjustment line that extends between a first location on the chassis plate and the fluid supply tube, wherein the adjustment line is connected to the fluid supply tube at a location spaced apart from the chassis plate, and the adjustment line is configured to draw the fluid supply tube toward the first location whereby the fluid supply tube is adjustable between a first position in which a centerline of the fluid supply tube is generally parallel with the second transverse axis, and a second position in which the centerline of the fluid supply tube is angled relative to the second transverse axis.

11. The gutter cleaning device of claim 1, wherein the chassis plate is planar.

12. The gutter cleaning device of claim 1, wherein the chassis plate is curved.

13. The gutter cleaning device of claim 1, wherein a gutter-facing surface of the chassis plate is convexly curved.

14. The gutter cleaning device of claim 1, wherein a gutter-facing surface of the chassis plate includes a low-friction material.

15. The gutter cleaning device of claim 1, comprising a debris detector including one or more of an optical sensor, an ultrasound sensor, a camera, a display unit and a mirror.

16. The gutter cleaning device of claim 1, comprising a vee shaped tree jack.

17. A gutter cleaning device, comprising a chassis plate having a leading end, a trailing end and a longitudinal axis that extends between the leading end and the trailing end, the chassis plate being elongated along the longitudinal axis, a fluid supply tube that terminates in a nozzle, the nozzle including an outlet opening and a centerline that defines a nozzle axis and is concentric with the outlet opening, the nozzle being secured to the chassis plate such that the nozzle axis is angled acutely relative to the longitudinal axis, a plough that extends outward from the leading end, a nozzle-facing surface of the plough having a convex portion configured to urge debris toward the nozzle axis, and a fluid-driven agitation device disposed on the nozzle axis.

18. The gutter cleaning device of claim 17, wherein the plough has a proximal end connected to the chassis plate leading end, and a distal tip that is opposed to the proximal end, and a straight line extending between the proximal end and the distal tip is angled relative to the longitudinal axis.

19. The gutter cleaning device of claim 17, wherein the fluid-driven agitation device is an elongate strip of flexible material having a fixed end secured to the nozzle.

20. The gutter cleaner of claim 17, wherein the chassis plate includes a first transverse axis perpendicular to the longitudinal axis that is aligned with a width direction of the chassis plate, a second transverse axis perpendicular to the first transverse axis and the longitudinal axis, the second transverse axis being aligned with the thickness direction of the chassis plate, and an adjustment line that extends between a first location on the chassis plate and the fluid supply tube, wherein the adjustment line is connected to the fluid supply tube at a location spaced apart from the chassis plate, and the adjustment line is configured to draw the fluid supply tube toward the first location whereby the fluid supply tube is adjustable between a first position in which a centerline of the fluid supply tube is generally parallel with the second transverse axis, and a second position in which the centerline of the fluid supply tube is angled relative to the second transverse axis.

* * * * *